United States Patent [19]

Alpha

[11] Patent Number: 4,918,816

[45] Date of Patent: Apr. 24, 1990

[54] PENCIL SHARPENER

[76] Inventor: Anthony J. Alpha, P.O. Box 844, Amelia, La. 70340

[21] Appl. No.: 329,547

[22] Filed: Mar. 28, 1989

[51] Int. Cl.[5] ..... B21D 39/00

[52] U.S. Cl. ..... 30/452; 30/453; 144/28.1; 144/28.71

[58] Field of Search ..... 30/452, 453, 458, 459, 30/451, 90.1–91.1, 109, 110–112; 144/28.1, 28.11, 28.2, 28.3, 28.6, 28.7, 28.71, 28.72

[56] References Cited

U.S. PATENT DOCUMENTS 673,770 5/1901 Fortunati ..... 30/453

1,160,091 11/1915 Steward ..... 144/28.71

3,965,949 6/1976 Aston et al. ..... 144/28.71

*Primary Examiner*—Frederick R. Schmidt

*Assistant Examiner*—Maurina Rachuba

*Attorney, Agent, or Firm*—H. Jay Spiegel

[57] ABSTRACT

The present invention relates to a pencil sharpener designed to be used in sharpening pencils having an elongated cross section such as, for example, elliptical or rectangular. The sharpener includes four cutters which are disposed in the casing thereof in facing pairs with one pair of blades being perpendicular to the other pair. Gearing is provided to allow all of the blades to rotate simultaneously and at the same speed.

10 Claims, 3 Drawing Sheets

PENCIL SHARPENER

BACKGROUND OF THE INVENTION

The invention disclosed herein is an improvement over the invention disclosed in applicant's U.S. Pat. No. 4,759,129, issued July 26, 1988, which patent is incorporated by reference herein.

Applicant's prior U.S. patent discloses a pencil sharpener designed to sharpen pencils of elongated cross section. The sharpener disclosed therein accomplishes this feat by providing two pairs of cutters wherein each cutter defines only a portion of the circumference of a circle. As one pair of cutters is engaging to sharpen surfaces engaged thereby, the other pair of cutters is indexed away from engagement with the pencil.

Through the use of the teachings of the pencil sharpener disclosed in applicant's prior U.S. patent, effective sharpening of a pencil of elongated cross section may be accomplished, however, since each cutter is only in engagement with the pencil which is being sharpened for about one third of every revolution, sharpening of a pencil using the teachings of applicant's prior patent may be relatively time consuming.

As such, a need has developed for a pencil sharpener which may be used to sharpen pencils of elongated cross section, which pencil sharpener includes cutter blades which will sharpen the surfaces of the pencil continuously during revolution of the cutter blades.

SUMMARY OF THE INVENTION

The present invention overcomes the deficiencies described above concerning applicant's prior patent and provides a new and improved pencil sharpener with cutter blades extending the full 360 degrees to ensure continuous sharpening of all surfaces of a pencil of elongated cross section simultaneously. The present invention includes the following interrelated aspects and features:

(a) In a first aspect, the present invention includes a casing having all gearing and cutters contained therein. A handle is mounted exteriorly of the casing and has a drive shaft which is rotated by rotating the handle.

(b) The drive shaft rotates a gear train which results in the simultaneous rotation of four cutter blades which are mounted in opposed pairs with one pair being mounted in the casing perpendicular to the other pair.

(c) Each cutter consists of an alternating configuration with cutting surfaces extending entirely about the circumference thereof. This alternating configuration is created by two side-by-side cutter members combining to form a single cutter, with the cutter members consisting of a first cutter member comprising one-half the cutting surface of the entire circumference and which is set at 90 degrees to a second cutter member comprising the other one-half of the cutting surface of the remainder of the said circumference, both being adjacent one another to provide the alternating configuration described above.

(d) In each pair of cutters, the cutter member on one cutter that is engaged to sharpen a given surface faces the cutter member on the other cutter which is indexed away from engagement with the pencil, and visa versa. Nevertheless, the pair of cutters mesh with a second pair of cutters in that the first pair is perpendicular to the second pair, thus allowing each single cutter to be engaged with a pencil at all times.

(e) Since each cutter has a cutting surface extending completely about the circumference thereof, a pencil inserted in the sharpener will be continuously sharpened as long as the handle thereof is being rotated. The casing has a bushing of inner dimensions designed to match the outer dimensions of the pencil which is to be sharpened to act as a guide for insertion of the pencil into the casing. This bushing may be easily removed and replaced with a bushing of different inner shape to allow the inventive pencil sharpener to be adapted to pencils of different outer configurations.

Accordingly, it is a first object of the present invention to provide an improved pencil sharpener. It is a further object of the present invention to provide an improved pencil sharpener designed to sharpen pencils of elongated cross-section.

It is a further object of the present invention to provide such an improved pencil sharpener wherein the cutters thereof have cutting surfaces extending completely about the circumference thereof.

It is a yet further object of the present invention to provide a pencil sharpener wherein the cutters thereof have an alternating configuration.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 2:
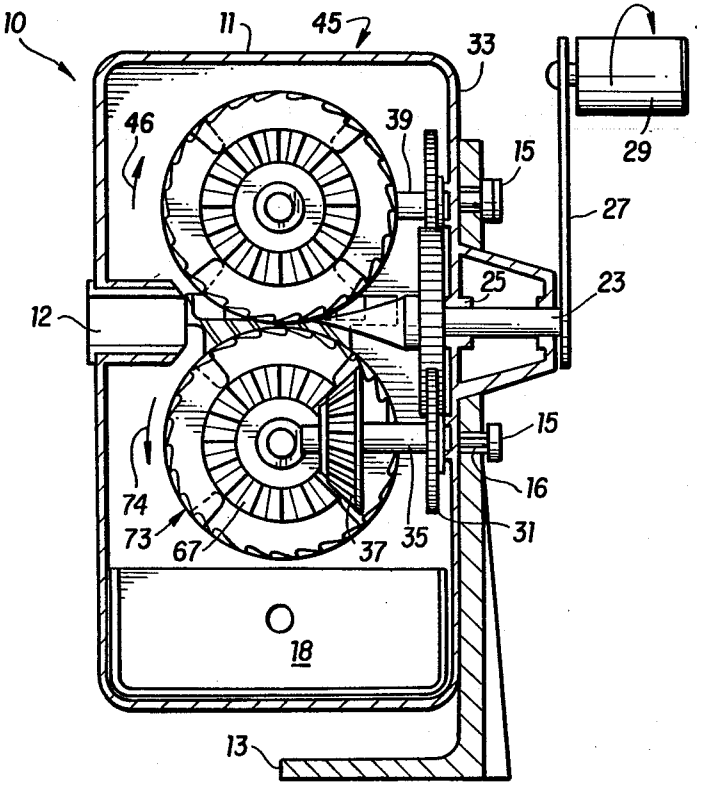
FIG. 2 shows a side view of the present invention with the casing partially broken away to show detail.

Reference is first made to FIGS. 1–4 wherein the inventive pencil sharpener is generally designated by the reference numeral 10 and is seen to include a housing 11 detachably connected to a mounting bracket 13 by virtue of pins 15 mounted on the casing 11 which may be inserted through slots 17 of the bracket 13 at the wide portions 19 thereof, with the casing 11 thereafter being rotated so that the shafts 16 of the pins 15 will be located in the narrow portions 21 of the slots 17 of the bracket 13 to thereby maintain the casing 11 in mounted position on the bracket 13.

Figure 1:
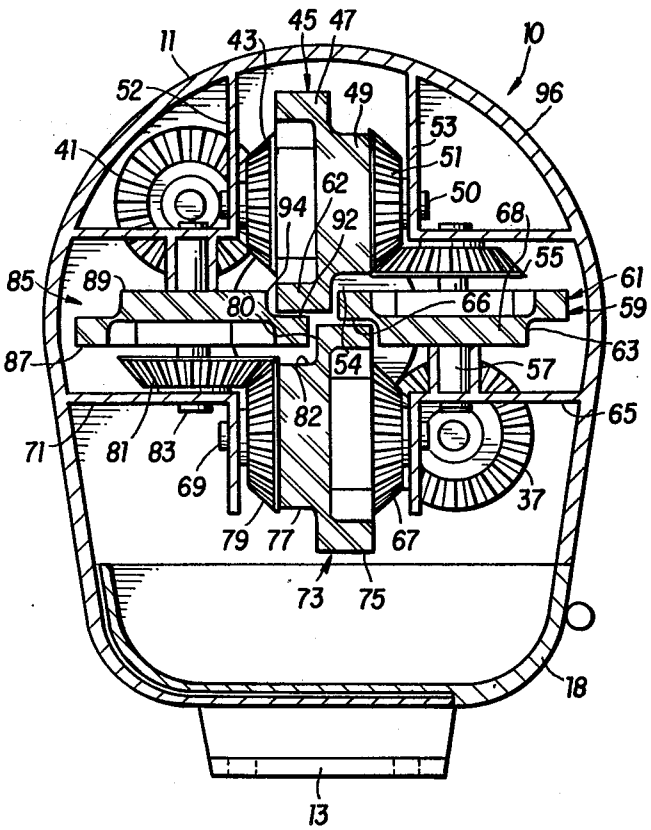
FIG. 1 shows a front view of the present invention with the casing partially broken away to show detail.
Figure 3:
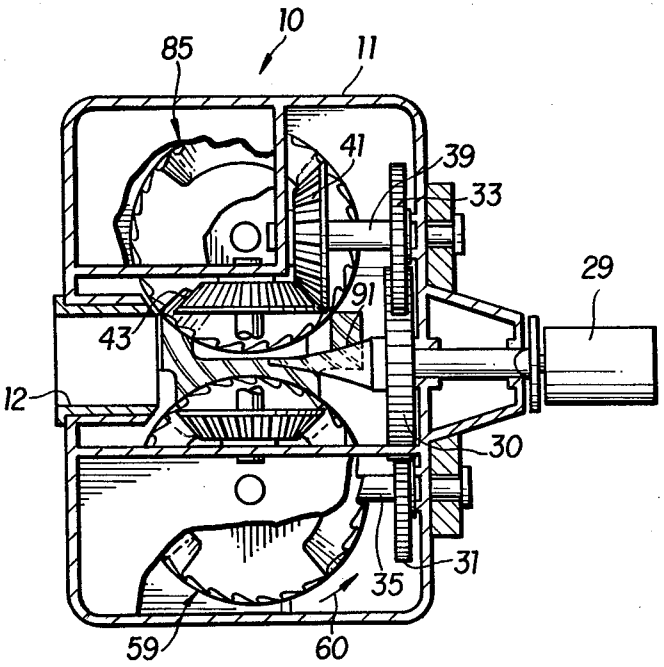
FIG. 3 shows a top view of the present invention with the casing partially broken away to show detail.
Figure 4:
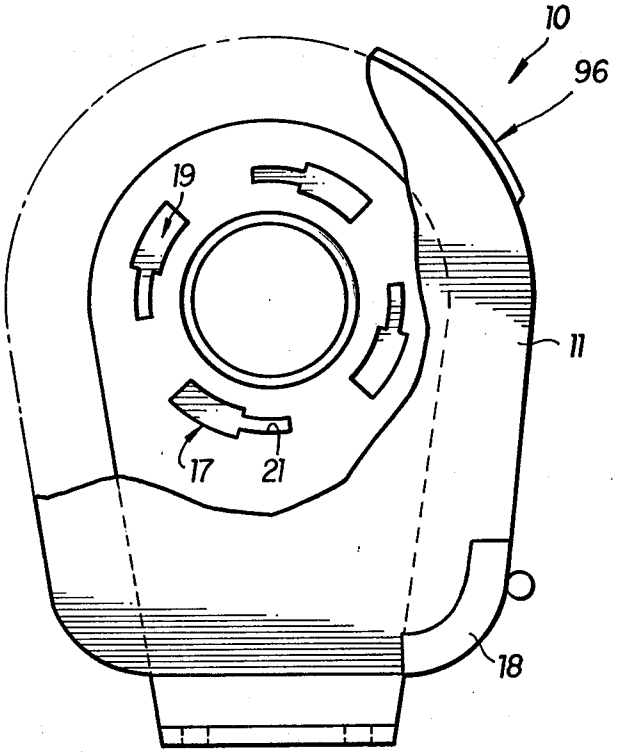
FIG. 4 shows a front view of the casing and bracket.
Figure 5:
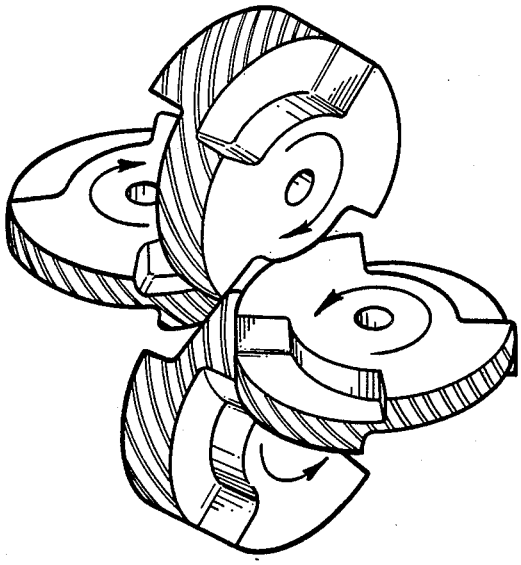
FIG. 5 shows a perspective view of the cutters and their interrelation.

As is seen in FIGS. 1, 2 and 4, a shavings tray 18 is provided in the casing 11 to allow the removal of shavings from the bottom of the casing 11. Furthermore, a bushing 12 is provided and designed to guide a pencil in insertion within the casing 11 and into engagement with the cutting mechanism of the inventive pencil sharpener 10. Comparison of FIGS. 2 and 3 reveals that the bushing 12 has an elongated cross-section which is narrow in the side view and wide in the top view for horizontal insertion of a pencil of elongated cross-section.

With reference to FIGS. 1, 2 and 3, it is seen that the casing 11 has an opening 25 therethrough through which drive shaft 23 extends. An operating handle 27 with a grip 29 rotatably mounted thereon is attached to the drive shaft 23 at its outer end with its inner end being rigidly attached to the drive gear 30.

The drive gear 30 is meshed with the gears 31 and 33 seen in FIGS. 2 and 3. The gear 31 has a shaft 35 drivingly connecting the gear 31 to a miter gear 37. Correspondingly, the gear 33 has a shaft 39 drivingly connecting the gear 33 to the miter gear 41.

The miter gear 41 is enmeshed with a further miter gear 43 which is connected to a first cutter 45 having a cutter member 47 with cutting blades divided into two cutting sections each covering 90 degrees of the circumference of a circle and diametrically spaced apart to make up one-half of the circumference thereof, and having a cutter member 49 also having cutting blades which are divided into two cutting sections each covering 90 degrees of the circumference of a circle and diametrically spaced to make up the remaining one-half of the circumference thereof. The cutter members 47 and 49 are created side-by-side and rotated 90 degrees with respect to one another to form the single cutter 45 shown. The cutter members 47 and 49 as integrated into a single cutter 45 are constrained to rotate together along with the miter gear 43. As should be understood by those skilled in the art, the cutters 59, 73 and 85 described hereinbelow are of the same construction as the said cutter 45.

Also constrained to rotate with the miter gear 43 and the cutter 45 is a further miter gear 51 rotatably mounted on a bracket 53 within the casing 11. A similar bracket 52 carries the miter gear 43 and together with the bracket 53 supports the gears 43 and 51 as well as the cutter 45 within the casing 11.

The miter gear 51 is drivingly connected to a further miter gear 55 also rotatably supported on the bracket 53, which miter gear 55 is connected via a drive shaft 57 with cutter 59 having a cutter member 61 and a cutter member 63. The drive shaft 57 is supported by the bracket 53 at one end and by a further bracket 65 at its other end. Thus, the gear 33 when rotated by rotations of the drive gear 30 will act to rotate both the cutters 45 and 59 via the various gears and shafts described hereinabove. In this regard, the gears 43 and 51 as well as the cutter 45 are supported on a shaft 50.

With further reference to FIGS. 1–3, it is seen that the miter gear 37 is meshed with a further miter gear 67 drivingly mounted on a shaft 69 supported between the bracket 65 and a further bracket 71 both of which brackets are within the casing 11.

The gear 67 is drivingly connected to a further cutter 73 including a cutter member 75 and a cutter member 77. Also drivingly mounted on the shaft 69 is a further miter gear 79 which meshes with a yet further miter gear 81 drivingly mounted on a shaft 83 supported at one end on the bracket 71 and at another end on the bracket 52 previously mentioned. Also drivingly mounted on the shaft 83 is a fourth cutter 85 including a cutter member 87 and a cutter member 89. Thus, rotations of the gear 31 via rotations of the drive gear 30 will result in rotation of the cutters 73 and 85 via the various gears and shafts described hereinabove.

A pencil stop 91 is contained within the casing to limit the extent of insertion of a pencil through the bushing 12 and into the path of the cutters 45, 59, 73 and 85.

With reference to FIG. 2 and 3, rotations of the handle 27 in a clockwise direction will result in rotations of the cutter 45 in the direction of the arrow 46, rotations of the cutter 73 in the direction of the arrow 74, rotations of the cutter 59 in the direction of the arrow 60 and rotations of the cutter 85 in the direction of the arrow 86. As should be understood from FIGS. 1, 2 and 3, when a pencil is guided into the casing 11 via the bushing 12, the pencil of elongated cross-section, will be effectively sharpened on all sides thereof due to the particular alternating configuration of the cutter members. Thus, with particular reference to FIG. 1, it is seen that the cutter 45 with cutter members 47 and 49 presents cutting surfaces 62 and 54 to the pencil. Similarly, the cutter 73 presents, to the pencil, cutter surfaces 80, 82. Similarly, the cutter 59 presents, to the pencil, cutter surfaces 66, 68. Finally, the cutter 85 presents, to the pencil, cutter surfaces 92, 94. Since the cutter surfaces extend circumferentially of all cutters, the inventive pencil sharpener 10 will sharpen a pencil continuously without break so long as the handle 27 is rotated by grasping the member 29. If desired, the casing 11 may have thereon a rasp 96 which may be used to rub the sharpened pencil thereagainst to create a finer point as desired.

As such, an invention has been disclosed in terms of a preferred embodiment thereof which fulfills each and every one of the objects of the present invention and provides a new and improved pencil sharpener of great novelty and utility. Of course, various changes, modifications and alterations of the teachings of the present invention may be contemplated by those skilled in the art without departing from the intended spirit and scope thereof. As such, it is intended that the present invention only be limited by the terms of the appended claims.

I claim:

1. An improved pencil sharpener having a sharpener mechanism comprising:

(a) an actuator shaft bearingly supported by support structure;

(b) force transmission means associated with said shaft for transmitting rotations of said shaft;

(c) a first pair of opposed cutters drivingly connected with said shaft via said force transmission means;

(d) a second pair of opposed cutters drivingly connected with said shaft via said force transmission means;

(e) each said cutter having a cutting surface extending completely circumferentially thereabout; and (f) said cutters comprising cutting means configured for sharpening a pencil of elongated cross-section.

2. The invention of claim 1, wherein each said cutter includes a first cutter member and a second cutter member, said cutter members being mounted together to provide an alternating cutter configuration for each cutter.

3. The invention of claim 1, wherein said first pair of cutters includes a first cutter and second cutter, said second pair of cutters including a third cutter and a fourth cutter, said first and third cutters being enmeshed in a first gear train and said second and fourth cutters being enmeshed in a second gear train.

4. The invention of claim 1, wherein said support structure comprises a casing surrounding said sharpener mechanism and removably mountable on a bracket.

5. The invention of claim 4, further including a bushing removably mounted on said casing, said bushing having an opening of elongated cross-section, said opening guiding said pencil into and out of said casing.

6. The invention of claim 4, further including a shavings tray in said casing which may be removed to empty said casing of pencil shavings.

7. The invention of claim 4, further including a rasp on said casing.

8. The invention of claim 3, wherein each said gear train includes, in order, a first miter gear, a second miter gear, a shaft carrying said second miter gear, a cutter and a third miter gear, a fourth miter gear and a shaft carrying said fourth miter gear and a further cutter, said cutter and further cutter being perpendicular to one another.

9. An improved pencil sharpener having a sharpener mechanism comprising:

(a) an actuator shaft bearingly supported by support structure;

(b) force transmission means associated with said shaft for transmitting rotations of said shaft;

(c) a first pair of opposed cutters drivingly connected with said shaft via said force transmission means;

(d) a second pair of opposed cutters drivingly connected with said shaft via said force transmission means;

(e) each said cutter (1) having a cutting surface extending completely circumferentially thereabout, and (2) including a first cutter member and a second cutter member, said cutter members being mounted together to provide an alternating cutter configuration for each cutter; and (f) said cutters being configured to sharpen a pencil of elongated cross-section.

10. An improved pencil sharpener having a sharpener mechanism comprising:

(a) an actuator shaft bearingly supported by support structure;

(b) force transmission means associated with said shaft for transmitting rotations of said shaft;

(c) a first pair of opposed cutters comprising a first cutter and a second cutter drivingly connected with said shaft via said force transmission means;

(d) a second pair of opposed cutters comprising a third cutter and a fourth cutter drivingly connected with said shaft via said force transmission means;

(e) said first and third cutters being enmeshed in a first gear train and said second and fourth cutters being enmeshed in a second gear train;

(f) each said cutter having a cutting surface extending completely circumferentially thereabout; and (g) said cutters being configured to sharpen a pencil of elongated cross-section.

* * * * *